US012565721B1

(12) United States Patent
Ray et al.

(10) Patent No.: US 12,565,721 B1
(45) **Date of Patent: *Mar. 3, 2026**

(54) HIGH-STRENGTH ISOTROPIC WOVEN SILT FENCE FABRICS

(71) Applicant: Willacoochee Industrial Fabrics, Inc., Nashville, GA (US)

(72) Inventors: Kevin William Ray, Enigma, GA (US); Melissa Grace, Gulf Breeze, FL (US); Eric Lee Booth, Nashville, GA (US)

(73) Assignee: Willacoochee Industrial Fabrics, Inc., Nashville, GA (US)

( * ) Notice: Subject to any disclaimer, the term of this patent is extended or adjusted under 35 U.S.C. 154(b) by 0 days.

This patent is subject to a terminal disclaimer.

(21) Appl. No.: 19/186,983

(22) Filed: Apr. 23, 2025

Related U.S. Application Data

(60) Provisional application No. 63/752,416, filed on Jan. 31, 2025.

(51) Int. Cl.

| | |
|---|---|
| ***E04H 17/00*** | (2006.01) |
| ***D03D 15/283*** | (2021.01) |
| ***D03D 15/37*** | (2021.01) |
| ***D03D 15/44*** | (2021.01) |
| ***D03D 15/47*** | (2021.01) |
| ***D03D 15/54*** | (2021.01) |
| ***D03D 15/573*** | (2021.01) |
| *D03D 1/00* | (2006.01) |

(52) U.S. Cl.
CPC ..... *D03D 15/573* (2021.01); *D03D 15/283* (2021.01); *D03D 15/37* (2021.01); *D03D 15/44* (2021.01); *D03D 15/47* (2021.01); *D03D 15/54* (2021.01); *D10B 2505/204* (2013.01)

(58) Field of Classification Search
CPC .... D03D 15/573; D03D 15/283; D03D 15/37; D03D 15/44; D03D 15/47; D03D 15/54; D10B 2505/204
See application file for complete search history.

(56) References Cited

U.S. PATENT DOCUMENTS 5,108,224 A * 4/1992 Cabaniss ..... D03D 9/00 405/15
RE42,695 E 9/2011 Singleton
(Continued)

OTHER PUBLICATIONS

U.S. Appl. No. 19/177,106, filed Apr. 11, 2025 entitled Woven Silt Fence Fabrics.

(Continued)

*Primary Examiner* — Robert H Muromoto, Jr.
(74) *Attorney, Agent, or Firm* — Harness, Dickey & Pierce, P.L.C.; Anthony G. Fussner

(57) ABSTRACT

A woven silt fence fabric is configured to have: a tensile strength greater than 140 pounds per ASTM D-4632 in the machine direction (MD); a tensile strength greater than 140 pounds per ASTM D-4632 in the cross machine direction (CMD) per ASTM D-4632; and one or more parameter(s) (per an ASTM test method) in the machine direction (MD) equal or approximately equal to the one or more parameter(s) (per the ASTM test method) in the cross machine direction (CMD). The woven silt fence fabric includes one or more marker yarns having a different color than adjacent yarn(s) to thereby identify one or more of a grade line, an install line, a monitor line, and/or a high visibility line.

25 Claims, 3 Drawing Sheets

| | | | Isotropic High Strength | |
|---|---|---|---|---|
| Property | Unit of Measure | Test Method | WINFAB Sample A | WINFAB Sample B |
| | | | WINFAB | WINFAB |
| Tensile Strength (Grab) MD* | lbs | ASTM D-4632 | 658 | 380 |
| Tensile Strength (Grab) CMD* | lbs | ASTM D-4632 | 660 | 327 |
| Trap Tear MD* | lbs | ASTM D-4533 | 297 | 157 |
| Trap Tear CMD* | lbs | ASTM D-4533 | 280 | 134 |
| Apparent Opening Size* | US Std. Sieve | ASTM D-4751 | 2688 | 1542 |
| Water Flow Rate* | gpm | ASTM D-4491 | 76 | 75.4 |
| Permittivity* | $sec^{-1}$ | ASTM D-4491 | 1.00 | 1.04 |

*Properties as recorded from published data sheets for each product

| | | |
|---|---|---|
| **Calculated Balanced Strength:** *Higher Value less Lower Value/Higher Value ASTM D-4632 Tensile Strength* | 0% | 14% |

(56) References Cited

U.S. PATENT DOCUMENTS

| | | | | |
|---|---|---|---|---|
| 8,747,027 | B1 | 6/2014 | Singleton | |
| 9,404,233 | B2 | 8/2016 | Jones et al. | |
| 10,024,022 | B2 * | 7/2018 | Booth | D03D 13/008 |
| 10,145,080 | B2 | 12/2018 | Segroves et al. | |
| 10,434,445 | B2 * | 10/2019 | Ray | D03D 13/008 |
| 10,487,471 | B2 * | 11/2019 | Booth | D03D 13/008 |
| 10,508,400 | B2 * | 12/2019 | Booth | E02D 17/202 |
| 11,174,612 | B2 * | 11/2021 | Booth | D03D 15/567 |
| 11,384,458 | B2 * | 7/2022 | Ray | D03D 15/43 |
| 11,634,880 | B2 * | 4/2023 | Segroves | D03D 15/43 256/12.5 |
| 11,873,588 | B2 * | 1/2024 | Ray | D03D 15/46 |
| D1,058,321 | S | 1/2025 | Taylor | |
| 12,410,543 | B1 * | 9/2025 | Booth | E04H 17/00 |
| 2014/0241817 | A1 * | 8/2014 | Jones | E02D 3/005 442/203 |
| 2015/0159305 | A1 * | 6/2015 | Booth | E02D 17/202 442/189 |
| 2016/0362865 | A1 | 12/2016 | Segroves et al. | |
| 2017/0342675 | A1 * | 11/2017 | Booth | E02B 3/125 |
| 2017/0354907 | A1 * | 12/2017 | Ray | D03D 15/37 |
| 2018/0320332 | A1 * | 11/2018 | Booth | D03D 13/008 |
| 2019/0145028 | A1 * | 5/2019 | Jones | D03D 15/44 139/420 A |
| 2020/0030728 | A1 * | 1/2020 | Ray | D03D 15/47 |
| 2023/0265633 | A1 | 8/2023 | Segroves et al. | |
| 2023/0304249 | A1 | 9/2023 | Ray et al. | |
| 2025/0075458 | A1 | 3/2025 | Ray et al. | |
| 2025/0075459 | A1 | 3/2025 | Ray et al. | |

OTHER PUBLICATIONS

U.S. Appl. No. 19/177,095, filed Apr. 11, 2025 entitled Woven Silt Fence Fabrics.

U.S. Appl. No. 18/825,595, filed Sep. 5, 2025 entitled Woven Silt Fence Fabrics Including Two Or More Distinctly Different Colors Of Warp Yarns In The Machine Direction.

Winfab 105SF Product Data Sheet; <www.winfabusa.com;> 2021; 1 page.

Woven Geotextile W-100; <www.skaps.com;> accessed Jan. 28, 2025; 1 page.

VSF-Technical Data Sheet; VSF: Virginia DOT Silt Fence; <www.fergusongss.com;> 2022; 1 page.

TerraTex SF-D100 Data Sheet; <www.HanesGeo.com;> Jan. 2023; 1 page.

TerraTex SF-60 Product Data Sheet; <www.HanesGeo.com;> Jan. 2023; 1 page.

TerraTex GS; <www.HanesGeo.com;> Jan. 2023; 1 page.

SMARTfence® PL36; High-Tensile/High-Modulus Woven Geotextile Sediment Fence; Nov. 2023; 2 pages.

SMARTfence® 42 High-Tensile/High-Modulus Woven Geotextile Sediment Fence; Nov. 2023; 2 pages.

Propex 2130; Propex® Fabrics; <www.geotextile.com/sediment/sediment.htm;> Mar. 10, 2005; 3 pages.

LS125 Technical Data Sheet; ACF LS125: Super Grade; <www.fergusongss.com;> 2022; 1 page.

Winfab 121ODT Product Data Sheet; <www.winfabusa.com;> 2016; 1 page.

Winfab 77SF Product Data Sheet; www.winfabusa.com; 2016; 1 page.

Winfab 2020HDX-USA Product Data Sheet; <www.winfabusa.com;> Oct. 2, 2023; 1 page.

Winfab® 2098 Product Data Sheet; <www.winfabusa.com;> 2016; one page.

Fabric Property Chart; accessed Jan. 23, 2025; 1 page.

Geotextile Specification for Highway Applications; AASHTO Designation: M-288-00; 2000; 20 pages.

ECSTR3D; Erosion Control Plan Legend; Dec. 18, 2002; 1 page.

Beltech 1935 Georgia DOT Silt Fence Product Data Sheet; www.BeltonIndustries.com; Jun. 2014; 1 page.

Winfab 2098R COC Contractor's Source; Mar. 18, 2014; 1 page.

EI 14-003 New York State Department of Transportation Engineering Instruction; Standard Specification Section 737 Geosynthetics; Mar. 27, 2014; 28 pages.

Dubinsky, Gregg; Electronic Theses and Dissertations; Universty of Central Florida; STARS; Performance Evaluation of Two Silt Fence Geosynthetic Fabrics During and After Rainfall Event; http://library.ucf.edu; 2014; 158 pages.

* cited by examiner

| | | | Isotropic High Strength | |
|---|---|---|---|---|
| Property | Unit of Measure | Test Method | WINFAB Sample A | WINFAB Sample B |
| | | | WINFAB | WINFAB |
| Tensile Strength (Grab) MD* | lbs | ASTM D-4632 | 658 | 380 |
| Tensile Strength (Grab) CMD* | lbs | ASTM D-4632 | 660 | 327 |
| Trap Tear MD* | lbs | ASTM D-4533 | 297 | 157 |
| Trap Tear CMD* | lbs | ASTM D-4533 | 280 | 134 |
| Apparent Opening Size* | US Std. Sieve | ASTM D-4751 | 2688 | 1542 |
| Water Flow Rate* | gpm | ASTM D-4491 | 76 | 75.4 |
| Permittivity* | $sec^{-1}$ | ASTM D-4491 | 1.00 | 1.04 |

**Properties as recorded from published data sheets for each product*

| | | |
|---|---|---|
| **Calculated Balanced Strength:** *Higher Value less Lower Value/Higher Value* *ASTM D-4632 Tensile Strength* | 0% | 14% |

FIG. 1

| | | | Isotropic | | | | | | | | | |
|---|---|---|---|---|---|---|---|---|---|---|---|---|
| Property | Unit of Measure | Test Method | 2130 | 77SF | 105SF | 1211 | TerraTex GS | TerraTex 60 | TerraTex SF-D100 | LS125 | VSF | W100 |
| | | | Propex | WINFAB | WINFAB | WINFAB | Hanes Geo | Hanes Geo | Hanes Geo | Ferguson | Feguson | Skaps |
| Tensile Strength (Grab) MD* | lbs | ASTM D-4632 | 124 | 100 | 125 | 124 | 200 | 60 | 140 | 124 | 140 | 124 |
| Tensile Strength (Grab) CMD* | lbs | ASTM D-4632 | 124 | 100 | 124 | 124 | 200 | 60 | 140 | 124 | 140 | 124 |
| Trap Tear MD* | lbs | ASTM D-4533 | 65 | 50 | 65 | 65 | 75 | 30 | 65 | 65 | 65 | 45 |
| Trap Tear CMD* | lbs | ASTM D-4533 | 65 | 50 | 65 | 65 | 75 | 30 | 65 | 65 | 65 | 45 |
| Apparent Opening Size* | US Std. Sieve | ASTM D-4751 | 30 | 30 | 30 | 30 | 40 | 30 | 30 | 30 | 30 | 30 |
| Water Flow Rate* | gpm | ASTM D-4491 | 10 | 8 | 10 | 8 | 4 | | 8 | 8 | 8 | 10 |
| Permittivity* | $sec^{-1}$ | ASTM D-4491 | 0.05 | 0.1 | 0.1 | 0.1 | | 0.05 | 0.05 | 0.1 | 0.05 | |
| **Properties as recorded from published data sheets for each product* | | | | | | | | | | | | |
| **Calculated Balanced Strength:** *Higher Value less Lower Value/Higher Value ASTM D-4632 Tensile Strength* | | | 0% | 0% | 1% | 0% | 0% | 0% | 0% | 0% | 0% | 0% |

FIG. 2

| | | | Anisotropic | | Anisotropic High Strength | | | |
|---|---|---|---|---|---|---|---|---|
| Property | Unit of Measure | Test Method | 1210DT | 2098 | 2020HDX | 2030HDX | SF36 | SF42 |
| | | | WINFAB | WINFAB | WINFAB | WINFAB | Friendly Environment | Friendly Environment |
| Tensile Strength (Grab) MD* | lbs | ASTM D-4632 | 124 | 260 | 450 | 450 | 450 | 545 |
| Tensile Strength (Grab) CMD* | lbs | ASTM D-4632 | 105 | 180 | 260 | 340 | 200 | 410 |
| Trap Tear MD* | lbs | ASTM D-4533 | 65 | | | 175 | 175 | 210 |
| Trap Tear CMD* | lbs | ASTM D-4533 | 65 | | | 135 | 70 | 195 |
| Apparent Opening Size* | US Std. Sieve | ASTM D-4751 | 30 | 30 | 30 | 30 | 70 | 70 |
| Water Flow Rate* | gpm | ASTM D-4491 | 5 | 75 | 75 | 55 | 25 | 32 |
| Permittivity* | $sec^{-1}$ | ASTM D-4491 | 0.05 | | 1.0 | | | |
| **Properties as recorded from published data sheets for each product* | | | | | | | | |
| **Calculated Balanced Strength:** *Higher Value less Lower Value/Higher Value ASTM D-4632 Tensile Strength* | | | 15% | 31% | 42% | 24% | 56% | 25% |

FIG. 3

HIGH-STRENGTH ISOTROPIC WOVEN SILT FENCE FABRICS

CROSS-REFERENCE TO RELATED APPLICATION

This application claims priority to and the benefit of U.S. Provisional Application No. 63/752,416 filed Jan. 31, 2025, which is incorporated herein by reference in its entirety.

FIELD

The present disclosure relates to high-strength isotropic woven silt fence fabrics.

BACKGROUND

This section provides background information related to the present disclosure which is not necessarily prior art.

Silt fence systems, which include silt fence fabric, vertical supporting members (such as wooden stakes or metal posts), and fasteners (like staples, wire ties, or zip ties), have been utilized for many years to temporarily control erosion and sediment. The fabric component is often referred to as a silt fence, perimeter control fabric, or sediment and erosion control fabric, among other names.

Typically, the silt fence fabric is installed vertically in the field, perpendicular to the ground, and is attached to and supported by wooden or metal posts placed at varying intervals (eg., 4 feet, 6 feet, or 10 feet apart). Traditionally, the primary purpose of the silt fence fabric in the system is to allow water to flow through the fabric while filtering out sediment. The wooden stakes and metal posts are used to maintain the vertical position of the silt fence fabric, bearing most of the load from the sediment and water in the system.

Today, silt fence systems are considered the last line of defense against off-site discharge of stormwater and are recognized as critical best management practices in construction. But as recognized herein, the overall structural stability of this technology still needs to be better understood and developed.

DRAWINGS

The drawings described herein are for illustrative purposes only of selected embodiments and not all possible implementations, and are not intended to limit the scope of the present disclosure.

FIG. 1 includes a table of properties of two isotropic high strength woven silt fence fabrics (labeled WINFAB Sample A and WINFAB Sample B) according to exemplary embodiments of the present disclosure.

FIGS. 2 and 3 include tables of properties of various conventional fabrics.

DETAILED DESCRIPTION

Example embodiments will now be described more fully with reference to the accompanying drawings.

Disclosed herein are exemplary embodiments of high-strength isotropic woven silt fence fabrics. Exemplary embodiments disclosed herein address the need for superior strength, improved filtration, and erosion control in civil engineering and construction projects, leveraging the isotropic woven material's high tensile strength characteristics in both the machine direction (M D) and cross-machine direction (CM D) in applications where additional reinforcement with wire, netting, or chain link fence is traditionally used and/or is not desired. Additionally, marker yarn(s) may be included in the high-strength isotropic woven silt fence fabrics, which marker yarn(s) allow for identification to grade lines (eg., 1 inch wide, 2 inch wide, 3 inch wide, etc.), install lines (eg., 1 inch wide, 2 inch wide, 3 inch wide, etc.), monitor lines (e.g., 1 inch wide, 2 inch wide, 3 inch wide, etc.), aid in high visibility, etc.

As mentioned in the background, silt fence systems serve as a final barrier against off-site stormwater discharge and are widely recognized as essential best management practices in construction. Although silt fence fabrics have developed over many years, a better understanding and further development of the structural stability of silt fence technology is necessary.

In the 1980s, A moco Fabrics and Fibers Company introduced an early version of silt fence fabric, marketed under the trade name AMOCO™ PROPEX™ Silt Stop 1380. This fabric was made using slit tape yarn in the warp direction and open-end spun (OES) fill yarns. In the late 1980s and early 1990s, Amoco Fabrics and Fibers Company and other industry players introduced silt fence products featuring slit tape yarns in both the warp and fill directions. Notable examples included Amoco's PROPEX™ 2125 and PROPEX™ 2130. These silt fence fabrics offered a range of strength, sediment retention, and hydraulic properties while remaining cost-effective. However, industry professionals noted that these fabrics still faced challenges with strength performance in practical applications. Further into development, companies designed silt fence fabrics utilizing 100% monofilament yarns such as WINFAB® 2098.

As silt fence fabrics have evolved to enhance filtration efficiency, their use has become more widespread. Although various perimeter control practices and products are available, silt fence systems continue to be the preferred choice. However, the overall structural stability of these silt fence systems, especially in high-flow areas, has not been fully understood until now.

Silt fences are commonly used in environmentally sensitive areas during construction, serving both as protective barriers and visual markers or boundaries. Despite their usefulness, silt fences often struggle to maintain their vertical position, requiring additional measures to reduce risks either alongside or integrated into the silt fence system.

The use of slit tape warp and fill fabrics, along with monofilament/slit tape combination fabrics, has created a need for an evolution in silt fence fabrics. As demand for silt fence fabrics has increased, it has become evident that silt fence fabrics must function as part of a comprehensive silt fence system. These fabrics should not only act as a filtering mechanism but should also possess sufficient strength to ensure the integrity of the system under challenging field conditions, even at very low strain rates.

In construction areas with severe hydraulic conditions, silt fence fabric is often reinforced with materials like wire, plastic mesh, or chain link fencing. This reinforcement enhances the system's strength, helping maintain the fabric's upright position for optimal filtration, even when subjected to varying hydraulic forces and sediment loads, or during prolonged installation periods.

There are clear opportunities to improve traditional silt fence systems (with a now fourth component being strength) into what is often referred to as the "super" silt fence system, among other names. Current limitations of the traditional silt fence fabrics used in traditional silt fence systems are currently being addressed by adding layers of redundancy in perimeter control or incorporating fabric reinforcement into the silt fence system as described herein. For example, this could involve installing two rows of silt fence fabric or adding a backing to the silt fence fabric. Additionally, the inventors hereof have identified that increasing the strength of the silt fence fabric itself, without sacrificing or compromising its filtration capabilities, could provide several benefits, such as:

Reduced landfill waste

Faster and easier installation

Improved performance and reliability in the field

Lower material handling and shipping costs

As recognized herein, key design principles for silt fence fabrics include strength (specifically tensile, tear, and puncture properties), sediment retention (measured by Apparent Opening Size or AOS), and hydraulic properties (such as water flow and permittivity). While the overall filtration capabilities of silt fence fabrics are well established, there is a growing need for fabrics that provide structural reinforcement to the overall system. Preferably, the silt fence fabric is strong and rigid enough to eliminate the need for wire or netting reinforcements.

One example of a standard fabric is the WINFAB® 2020HDX silt fence fabric, which is an isotropic fabric made entirely from 100% monofilament warp and fill yarns. The WINFAB® 2020HDX silt fence fabric boasts high modulus properties, which makes the WINFAB® 2020HDX silt fence fabric an excellent replacement for other conventional fabrics like the WINFAB® 2098CS, which combines WINFAB® 2098 silt fence fabric with a 12-pound polypropylene net.

Another example of a traditional fabric is the SMARTfence 42 fabric. The SMARTfence 42 fabric is an anisotropic fabric made from a blended alternative featuring a combination of monofilament warp yarn and fibrillated slit tape fill yarn.

FIGS. 2 and 3 include tables that shows a progression of properties over time. Tensile strengths have improved. Most of the early silt fence fabrics as well as those currently in use today are isotropic in nature as can be seen in the fabric property table shown in FIG. 2. But these conventional fabrics have significantly less strength than the newer high-strength silt fence fabrics that eliminate the need for reinforcement such as WINFAB® 2020HDX fabric, SMARTfence 42 fabric, and SMARTfence 36 fabrics. As can be seen in FIG. 2, the high-strength fabrics are all anisotropic. In the case of SMARTfence fabrics, the anisotropic nature of the high-strength silt fence fabrics is explicitly discussed in U.S. Pat. Nos. 10,145,080 and 11,634,880.

Traditional silt fences may be isotropic in design. While these materials deliver basic functionality, they have limitations in terms of tensile strength, durability, and filtration efficiency, especially in high-stress or harsh environmental conditions. Current high-strength fabrics designed to withstand these shortcomings are all anisotropic in nature as noted in the table shown in FIG. 3.

Building on the observations above, the inventors developed and/or disclose herein exemplary high-strength isotropic woven silt fence fabrics that can withstand the demands of high-stress environmentally challenging conditions. See, for example, FIG. 1 that includes a table of properties of two isotropic high strength woven silt fence fabrics (labeled WINFAB Sample A and WINFAB Sample B) according to exemplary embodiments of the present disclosure.

As noted, fabric strength is important in the overall performance of the silt fence system. But as recognized herein, it is also equally and/or very important that the strength of the silt fence fabric be isotropic in nature rather than anisotropic. Exemplary embodiments of the high-strength isotropic woven silt fence fabrics disclosed herein exhibit one or more (preferably all, but not necessarily any or all) of the following advantages, properties, and/or characteristics regarding Uniform Strength Distribution, Improved Durability, Versatility in Installation, Superior Performance in High-Stress Conditions, Effective Sediment Control, and/or Enhanced Safety.

1. Uniform Strength Distribution
   - Equal Resistance to Forces: The high-strength isotropic woven silt fence fabrics disclosed herein are able to withstand stresses from water flow, sediment load, and environmental factors equally well in all directions, reducing the risk of localized failure.
   - Reduced Weak Points: Unlike anisotropic fabrics, which may be weaker in certain directions, the high-strength isotropic woven silt fence fabrics disclosed herein minimize or at least reduce the likelihood of tearing or deformation even under uneven loads.
2. Improved Durability
   - Enhanced Tear Resistance: The high-strength isotropic woven silt fence fabrics disclosed herein are able to resist tear propagation better thereby making the high-strength isotropic woven silt fence fabrics more reliable in situations where small damages might otherwise expand.
   - Longer Lifespan: The high-strength isotropic woven silt fence fabrics disclosed herein will perform consistently over time, even in harsh conditions, such as exposure to UV light, heavy rainfall, or sediment pressure.
3. Versatility in Installation
   - Ease of Orientation: The high-strength isotropic woven silt fence fabrics disclosed herein can be installed in any direction without compromising performance, thereby simplifying installation and reducing the risk of errors.
   - Adaptability to Terrain: The high-strength isotropic woven silt fence fabrics disclosed herein will perform consistently on irregular or sloped surfaces, thereby providing reliable sediment control regardless of ground orientation.
4. Superior Performance in High-Stress Conditions
   - Withstands Heavy Loads: The high-strength isotropic woven silt fence fabrics disclosed herein are ideal for sites with significant sediment or water flow pressures, such as construction sites on steep slopes or in areas prone to flooding.
   - Minimizes Sagging and Distortion: The high-strength isotropic woven silt fence fabrics disclosed herein have uniform strength that will help maintain a silt fence's structural integrity, thereby preventing sagging or collapse under stress.
5. Effective Sediment Control
   - Consistent Containment: The high-strength isotropic woven silt fence fabrics disclosed herein maintain substantially even tension and strength, thereby ensuring that sediment is reliably contained across the entire barrier.
   - Reduced Risk of Undermining: The balanced performance of the high-strength isotropic woven silt fence fabrics disclosed herein will reduce weak points where water or sediment might breach the barrier.
6. Enhanced Safety
   - Predictable Failure Behavior: In the rare event of failure, the high-strength isotropic woven silt fence fabrics disclosed herein would tend to fail uniformly, thereby reducing the risk of sudden breaches or localized damage that could exacerbate erosion.

Environmental Protection: By effectively controlling sediment, the high-strength isotropic woven silt fence fabrics disclosed herein can help prevent damage to nearby ecosystems, water bodies, and infrastructure.

As noted above, FIG. 1 that includes a table of properties of first and second isotropic high strength woven silt fence fabrics (labeled WINFAB Sample A and WINFAB Sample B) according to exemplary embodiments of the present disclosure. As shown in FIG. 1, the first isotropic high strength woven silt fence fabric (labeled WINFAB Sample A) comprised 1600 denier oval monofilament warp yarn, 5000 denier fibrillated tape fill yarn, and had the following properties:

Tensile Strength (Grab) of 658 pounds per ASTM D-4632 in the machine direction (MD);

Tensile Strength (Grab) of 660 pounds in the cross machine direction (CM D) per ASTM D-4632;

Trap Tear of 297 pounds in the machine direction (MD) per ASTM D-4533;

Trap Tear of 280 pounds in the cross machine direction (CM D) per ASTM D-4533;

Apparent Opening Size of 2688 US Std. Sieve per ASTM D-4751;

Water Flow Rate of 76 gallons per minute per ASTM D-4491;

Permittivity of 1.00 sec-1 per ASTM D-4491; and

Calculated Balanced Strength: Higher Value less Lower Value/Higher Value ASTM D-4632 Tensile Strength 0%.

With continued reference to FIG. 1, the second isotropic high strength woven silt fence fabric (labeled WINFAB Sample B) comprised 1200 denier oval monofilament warp yarn, 3000 denier fibrillated tape fill yarn, and had the following properties:

Tensile Strength (Grab) of 380 pounds per ASTM D-4632 in the machine direction (MD);

Tensile Strength (Grab) of 327 pounds in the cross machine direction (CM D) per ASTM D-4632;

Trap Tear of 157 pounds in the machine direction (MD) per ASTM D-4533;

Trap Tear of 134 pounds in the cross machine direction (CM D) per ASTM D-4533;

Apparent Opening Size of 1542 US Std. Sieve per ASTM D-4751;

Water Flow Rate of 75.4 gallons per minute per ASTM D-4491;

Permittivity of 1.04 sec-1 per ASTM D-4491; and

Calculated Balanced Strength: Higher Value less Lower Value/Higher Value ASTM D-4632 Tensile Strength 14%.

The high-strength isotropic woven silt fence fabrics disclosed herein are particularly suited for erosion and sediment control in construction sites, highways, agricultural land management, and other civil engineering applications where silt fences are employed and extreme hydraulic or sediment loading conditions are present or the project warrants the need for a long term perimeter and sediment control. The high-strength isotropic woven silt fence fabrics disclosed herein sets a new standard for silt fence applications, offering unmatched strength, reliability, durability, and environmental compatibility.

In exemplary embodiments, a silt fence comprises an isotropic woven silt fence fabric that is characterized by approximately equal tensile strength (per ASTM D 4632) in the machine direction (M D) and cross machine direction (CMD), which MD and CMD tensile strengths exceed that of conventional silt fence geotextiles (eg., tensile strength greater than AASHTO M 288 standards for a supported silt fence, tensile strength of about 140 pounds or higher, etc.).

In exemplary embodiments, a high-strength isotropic woven silt fence fabric comprises monofilament warp yarns and fibrillated fill yarns. The monofilament warp yarns and the fibrillated fill yarns may comprise a wide range of materials, such as polypropylene, polyester, polyethylene terephthalate (PET), nylon, rayon, polyethylene, fiberglass, terpolymer, acrylic, aramid fibers, natural fibers, biodegradable fibers, other polymers, other raw materials, etc. The monofilament warp yarns and the fibrillated fill yarns may have any suitable denier. The monofilament warp yarns may have any suitable cross sectional shape (eg., round, flat, multilobal, oval, trilobal, triangular, rectangular, non-circular, and/or non-rectangular, etc.). Additionally, the high-strength isotropic woven silt fence fabric may be configured to have any suitable end count, eg., depending on the particular installation, etc.

In exemplary embodiments, the yarn system used to weave the high-strength isotropic woven silt fence fabric may have any cross-sectional shapes, deniers, made of various materials, etc., In such exemplary embodiments, the yarn system used to weave the high-strength isotropic woven silt fence fabric may comprise monofilament yarns, slit tape yarns, slit tape fibrillated yarns, filament yarns, spun yarns, or any combination thereof.

In exemplary embodiments, the high-strength isotropic woven silt fence fabric is used in a silt fence system to improve durability, filtration, and cost-efficiency of the silt fence system.

Also disclosed are exemplary methods of manufacturing silt fences using high-strength isotropic woven silt fence fabrics to achieve superior performance metrics compared to traditional materials.

Exemplary methods are disclosed that comprise weaving warp yarns and fill yarns to provide a high-strength isotropic woven silt fence fabric. In such exemplary methods, a weave pattern for the woven silt fence fabric may comprise a plain or 1×1 weave, any twill weave (eg., 2×1, 2×2, 3×1, 3×3, 4×4, etc.), herringbones, satin, baskets, or leno.

In exemplary embodiments, the woven silt fence fabric is configured to be isotropic such that the higher value and the lower value of the tensile strengths (per the ASTM D-4632 test method) in the machine direction (MD) and the cross machine direction (CM D) are within a range from about 0% to 15% between the higher value and the lower value of the tensile strengths (per the ASTM D-4632 test method) in the machine direction (MD) and the cross machine direction (CMD) for any individual test specimen. For example, the woven silt fence fabric may be configured to have a calculated balanced strength less than 15%. Or, for example, the woven silt fence fabric may be configured to have a calculated balanced strength of about 14%. As another example, the woven silt fence fabric may be configured to have a calculated balanced strength of about 0%.

In exemplary embodiments, the woven silt fence fabric is configured to have a tensile strength of about 658 pounds per ASTM D-4632 in the machine direction (MD), and a tensile strength of about 660 pounds per ASTM D-4632 in the cross machine direction (CM D) per ASTM D-4632. In other exemplary embodiments, the woven silt fence fabric is configured to have a tensile strength of about 380 pounds per ASTM D-4632 in the machine direction (MD), and a tensile strength of about 327 pounds per ASTM D-4632 in the cross machine direction (CM D) per ASTM D-4632.

In exemplary embodiments, the high-strength isotropic woven silt fence fabrics are configured to have machine direction (M D) and cross machine direction (CMD) tensile strengths that are balanced or equal (eg., substantially balanced, about equal, etc.) according to ASTM D-4632. In such exemplary embodiments, the parameters of the high-strength isotropic woven silt fence fabrics are preferably configured to be balanced between the machine direction (MD) and cross machine direction (CMD) (according ASTM D-4632). In some exemplary embodiment, the parameter(s) (eg., tensile strength according ASTM D-4632, etc.) of the high-strength isotropic woven silt fence fabrics may be substantially balanced or about equal (eg., with varying degrees of allowances and/or manufacturing tolerances, etc.) between the machine direction (MD) and cross machine direction (CM D). Accordingly, the woven silt fence fabrics disclosed herein may still be referred to as isotropic when the higher value and the lower value of MD and CMD parameter(s) (eg., tensile strength (grab) according to ASTM D-4632, etc.) are within an acceptable percentage or range (eg., 15%, 20%, 25%, 30%, 35%, between 15% to 35%, etc.) between the higher value and the lower value for any individual test specimen, e.g.,:

- 15% or less between the higher value and the lower value for any individual test specimen; or
- 20% or less between the higher value and the lower value for any individual test specimen; or
- 25% or less between the higher value and the lower value for any individual test specimen; or
- 30% or less between the higher value and the lower value for any individual test specimen; or
- 35% or less between the higher value and the lower value for any individual test specimen.

Y arns used in the high-strength isotropic woven silt fence fabrics disclosed herein may comprise a wide range of materials, such as polypropylene, polyester, polyethylene terephthalate (PET), nylon, rayon, polyethylene, fiberglass, terpolymer, acrylic, aramid fibers, natural fibers, biodegradable fibers, other polymers, other raw materials, etc. The yarns used in the high-strength isotropic woven silt fence fabrics disclosed herein may have any suitable denier and/or any suitable cross sectional shape (e.g., round, flat, multilobal, oval, trilobal, triangular, rectangular, non-circular, and/or non-rectangular, etc.). Additionally, the high-strength isotropic woven silt fence fabrics disclosed herein may be configured to have any suitable end count, eg., depending on the particular installation, etc. Accordingly, the yarns used in the high-strength isotropic woven silt fence fabrics disclosed herein are not limited to any one specific material(s), denier, cross-sectional shape, or end count.

In exemplary embodiments, the woven silt fence fabric includes one or more marker yarns having a different color than adjacent yarn(s) to thereby identify one or more of a grade line, install line, monitor line, and/or high visibility line. In such exemplary embodiments, the one or more marker yarns comprise multiple groups of marker yarns having different color(s) than adjacent yarn(s) such the woven silt fence fabric includes two or more a grade line, an install line, a monitor line, and/or a high visibility line. And each group of marker yarns may have a same width as the other groups of marker yarns, or at least one group of marker yarns may have a different width than at least one other group of marker yarns. Additionally, or alternatively, the one or more of the grade line, install line, monitor line, and/or high visibility line identified by the one or more marker yarns may comprise a singular end(s) of the one or more marker yarns, or a wider group of multiple ends of the one or more marker yarns.

In exemplary embodiments, the woven silt fence fabric comprises warp yarn that extends or runs in the machine direction substantially parallel with a length of the woven silt fence fabric, and fill yarn that extends or runs in the cross machine direction substantially perpendicular to the length of the woven silt fence fabric. The warp yarn and the fill yarn may have any suitable cross-sectional shapes that are the same cross-sectional shape or different cross-sectional shapes from each other. The warp yarn and the fill yarn may have any suitable deniers that are the same denier or different deniers from each other. The warp yarn and the fill yarn may be made of any materials that are the same material or different materials from each other. And the warp yarn and the fill yarn may comprise monofilament yarns, slit tape yarns, slit tape fibrillated yarns, filament yarns, spun yarns, or any combination thereof. See, for example, the table below that includes different warp yarn and fill yarn combinations that may be in exemplary embodiments of the woven silt fence fabrics disclosed herein.

| Warp Yarn | Fill Yarn |
|---|---|
| Monofilament | Fibrillated |
| Monofilament | Tape |
| Monofilament | Filament |
| Monofilament | Spun |
| Tape | Monofilament |
| Tape | Fibrillated |
| Tape | Filament |
| Tape | Spun |
| Tape | Tape |
| Fibrillated | Monofilament |
| Fibrillated | Tape |
| Fibrillated | Filament |
| Fibrillated | Spun |
| Fibrillated | Fibrillated |
| Filament | Fibrillated |
| Filament | Tape |
| Filament | Spun |
| Filament | Monofilament |
| Filament | Filament |
| Spun | Monofilament |
| Spun | Filament |
| Spun | Tape |
| Spun | Fibrillated |
| Spun | Spun |

In exemplary embodiments, the woven silt fence fabric includes warp yarns and the fill yarns that comprise polypropylene, polyester, polyethylene terephthalate (PET), nylon, rayon, polyethylene, fiberglass, terpolymer, acrylic, aramid fibers, natural fibers, biodegradable fibers, other polymers, or other raw materials. A cross-sectional shape of the warp yarns and the fill yarns may include one or more of round, flat, multilobal, oval, trilobal, triangular, rectangular, non-circular, and/or non-rectangular.

In exemplary embodiments, the woven silt fence fabric comprises monofilament warp yarns and fibrillated fill yarns. In such exemplary embodiments, the monofilament warp yarns and the fibrillated fill yarns may comprise polypropylene, polyester, polyethylene terephthalate (PET), nylon, rayon, polyethylene, fiberglass, terpolymer, acrylic, aramid fibers, natural fibers, biodegradable fibers, other polymers, or other raw materials. A cross-sectional shape of the monofilament warp yarn may include one or more of round, flat, multilobal, oval, trilobal, triangular, rectangular, non-circular, and/or non-rectangular. For example, the monofilament warp yarn may comprise flat/oval monofilament with denier ranges from 500 to 1800 denier. Or, for example, the monofilament warp yarn may comprise round monofilament with denier ranges from 500 to 2000 denier.

In exemplary embodiments, a silt fence system includes a woven silt fence fabric as disclosed herein. One or more support posts are configured for attachment to the woven silt fence fabric for supporting the woven silt fence fabric. In such exemplary embodiments, the woven silt fence fabric may be configured to have high-strength characteristics that enable the silt fence system to be usable without additional wire, netting, or chain link fence reinforcement for the woven silt fence fabric.

Example embodiments are provided so that this disclosure will be thorough and will fully convey the scope to those who are skilled in the art. Numerous specific details are set forth such as examples of specific components, devices, and methods, to provide a thorough understanding of embodiments of the present disclosure. It will be apparent to those skilled in the art that specific details need not be employed, that example embodiments may be embodied in many different forms, and that neither should be construed to limit the scope of the disclosure. In some example embodiments, well-known processes, well-known device structures, and well-known technologies are not described in detail. In addition, advantages and improvements that may be achieved with one or more exemplary embodiments of the present disclosure are provided for purpose of illustration only and do not limit the scope of the present disclosure, as exemplary embodiments disclosed herein may provide all or none of the above mentioned advantages and improvements and still fall within the scope of the present disclosure.

Specific dimensions, specific materials, and/or specific shapes disclosed herein are example in nature and do not limit the scope of the present disclosure. The disclosure herein of particular values and particular ranges of values for given parameters are not exclusive of other values and ranges of values that may be useful in one or more of the examples disclosed herein. Moreover, it is envisioned that any two particular values for a specific parameter stated herein may define the endpoints of a range of values that may be suitable for the given parameter (i.e., the disclosure of a first value and a second value for a given parameter can be interpreted as disclosing that any value between the first and second values could also be employed for the given parameter). For example, if Parameter X is exemplified herein to have value A and also exemplified to have value Z, it is envisioned that parameter X may have a range of values from about A to about Z. Similarly, it is envisioned that disclosure of two or more ranges of values for a parameter (whether such ranges are nested, overlapping, or distinct) subsume all possible combination of ranges for the value that might be claimed using endpoints of the disclosed ranges. For example, if parameter X is exemplified herein to have values in the range of 1-10, or 2-9, or 3-8, it is also envisioned that Parameter X may have other ranges of values including 1-9, 1-8, 1-3, 1-2, 2-10, 2-8, 2-3, 3-10, and 3-9.

The terminology used herein is for the purpose of describing particular example embodiments only and is not intended to be limiting. For example, when permissive phrases, such as "may comprise", "may include", and the like, are used herein, at least one embodiment comprises or includes the feature(s). As used herein, the singular forms "a", "an" and "the" may be intended to include the plural forms as well, unless the context clearly indicates otherwise. The terms "comprises," "comprising," "including," and "having," are inclusive and therefore specify the presence of stated features, integers, steps, operations, elements, and/or components, but do not preclude the presence or addition of one or more other features, integers, steps, operations, elements, components, and/or groups thereof. The method steps, processes, and operations described herein are not to be construed as necessarily requiring their performance in the particular order discussed or illustrated, unless specifically identified as an order of performance. It is also to be understood that additional or alternative steps may be employed.

When an element or layer is referred to as being "on", "engaged to", "connected to" or "coupled to" another element or layer, it may be directly on, engaged, connected, or coupled to the other element or layer, or intervening elements or layers may be present. In contrast, when an element is referred to as being "directly on," "directly engaged to", "directly connected to" or "directly coupled to" another element or layer, there may be no intervening elements or layers present. Other words used to describe the relationship between elements should be interpreted in a like fashion (e.g., "between" versus "directly between," "adjacent" versus "directly adjacent," etc.). As used herein, the term "and/or" includes any and all combinations of one or more of the associated listed items.

The term "about" when applied to values indicates that the calculation or the measurement allows some slight imprecision in the value (with some approach to exactness in the value; approximately or reasonably close to the value; nearly). If, for some reason, the imprecision provided by "about" is not otherwise understood in the art with this ordinary meaning, then "about" as used herein indicates at least variations that may arise from ordinary methods of measuring or using such parameters. For example, the terms "generally", "about", and "substantially" may be used herein to mean within manufacturing tolerances.

Although the terms first, second, third, etc. may be used herein to describe various elements, components, regions, layers and/or sections, these elements, components, regions, layers and/or sections should not be limited by these terms. These terms may be only used to distinguish one element, component, region, layer or section from another region, layer, or section. Terms such as "first," "second," and other numerical terms when used herein do not imply a sequence or order unless clearly indicated by the context. Thus, a first element, component, region, layer, or section discussed below could be termed a second element, component, region, layer, or section without departing from the teachings of the example embodiments.

Spatially relative terms, such as "inner," "outer," "beneath", "below", "lower", "above", "upper" and the like, may be used herein for ease of description to describe one element or feature's relationship to another element(s) or feature(s) as illustrated in the figures. Spatially relative terms may be intended to encompass different orientations of the device in use or operation in addition to the orientation depicted in the figures. For example, if the device in the figures is turned over, elements described as "below" or "beneath" other elements or features would then be oriented "above" the other elements or features. Thus, the example term "below" can encompass both an orientation of above and below. The device may be otherwise oriented (rotated 90 degrees or at other orientations) and the spatially relative descriptors used herein interpreted accordingly.

The foregoing description of the embodiments has been provided for purposes of illustration and description. It is not intended to be exhaustive or to limit the disclosure. Individual elements, intended or stated uses, or features of a particular embodiment are generally not limited to that particular embodiment, but, where applicable, are interchangeable and can be used in a selected embodiment, even if not specifically shown or described. The same may also be varied in many ways. Such variations are not to be regarded as a departure from the disclosure, and all such modifications are intended to be included within the scope of the disclosure.

What is claimed is:

1. A woven silt fence fabric configured to have:

a tensile strength greater than 140 pounds per ASTM D-4632 in the machine direction (MD);

a tensile strength greater than 140 pounds per ASTM D-4632 in the cross machine direction (CMD) per ASTM D-4632; and one or more parameter(s) (per an ASTM test method) in the machine direction (MD) equal or approximately equal to the one or more parameter(s) (per the ASTM test method) in the cross machine direction (CMD);

wherein the woven silt fence fabric includes one or more marker yarns having a different color than adjacent yarn(s) to thereby identify one or more of a grade line, an install line, a monitor line, and/or a high visibility line.

2. The woven silt fence fabric of claim 1, wherein the woven silt fence fabric configured such that the tensile strength per ASTM D-4632 in the machine direction (MD) of the woven silt fence fabric is equal to the tensile strength per ASTM D-4632 in the cross machine direction (CMD) of the woven silt fence fabric.

3. The woven silt fence fabric of claim 1, wherein the woven silt fence fabric configured such that the tensile strength per ASTM D-4632 in the machine direction (MD) of the woven silt fence fabric is approximately equal to the tensile strength per ASTM D-4632 in the cross machine direction (CMD) of the woven silt fence fabric.

4. The woven silt fence fabric of claim 1, wherein the woven silt fence fabric is an isotropic woven silt fence fabric.

5. The woven silt fence fabric of claim 1, wherein the woven silt fence fabric is a high-strength isotropic woven silt fence fabric comprising monofilament warp yarns and fibrillated fill yarns.

6. The woven silt fence fabric of claim 1, wherein the woven silt fence fabric configured such that the tensile strength per ASTM D-4632 in the machine direction (MD) of the woven silt fence fabric is equal or approximately equal to the tensile strength per ASTM D-4632 in the cross machine direction (CMD) of the woven silt fence fabric, and the tensile strengths in the machine direction (MD) and cross machine direction (CMD) of the woven silt fence fabric exceed that of a conventional silt fence geotextile.

7. The woven silt fence fabric of claim 1, wherein the woven silt fence fabric configured such that the tensile strength per ASTM D-4632 in the machine direction (MD) of the woven silt fence fabric is equal or approximately equal to the tensile strength per ASTM D-4632 in the cross machine direction (CMD) of the woven silt fence fabric, and the tensile strengths in the machine direction (MD) and cross machine direction (CMD) of the woven silt fence fabric are greater than the AASHTO M288 standard for a supported silt fence.

8. The woven silt fence fabric of claim 1, wherein the woven silt fence fabric comprises:

monofilament warp yarn that extends or runs in the machine direction substantially parallel with a length of the woven silt fence fabric; and fibrillated fill yarn that extends or runs in the cross machine direction substantially perpendicular to the length of the woven silt fence fabric.

9. The woven silt fence fabric of claim 8, wherein the monofilament warp yarn comprises:

flat/oval monofilament having a denier within a range from 500 to 1800 denier; or round monofilament having a denier within a range from 500 to 2000 denier.

10. The woven silt fence fabric of claim 1, wherein the woven silt fence fabric is configured to have physical and/or mechanical properties that are isotropic in regard to the warp and fill construction.

11. The woven silt fence fabric of claim 10, wherein the woven silt fence fabric includes fill yarns that are bundled together, via weaving technology, to thereby configure the woven silt fence fabric to have physical and/or mechanical properties that are isotropic in regard to the warp and fill construction.

12. The woven silt fence fabric of claim 1, wherein the one or more marker yarns comprise multiple groups of marker yarns having different color(s) than adjacent yarn(s) such the woven silt fence fabric includes two or more a grade line, an install line, a monitor line, and/or a high visibility line, and wherein:

each group of marker yarns has a same width as the other groups of marker yarns; or at least one group of marker yarns has a different width than at least one other group of marker yarns.

13. The woven silt fence fabric of claim 1, wherein the one or more of the grade line, install line, monitor line, and/or high visibility line identified by the one or more marker yarns comprise:

a singular end(s) of the one or more marker yarns; or a wider group of multiple ends of the one or more marker yarns.

14. The woven silt fence fabric of claim 1, wherein the woven silt fence fabric is configured to be isotropic such that the higher value and the lower value for one or more parameter(s) (per an ASTM test method) in the machine direction (MD) and the cross machine direction (CMD) are within a range from about 15% to about 35% between the higher value and the lower value for any individual test specimen.

15. The woven silt fence fabric of claim 1, wherein the woven silt fence fabric is configured to be isotropic such that the higher value and the lower value of the tensile strengths (per the ASTM D-4632 test method) in the machine direction (MD) and the cross machine direction (CMD) are within a range from about 0% to 15% between the higher value and the lower value of the tensile strengths (per the ASTM D-4632 test method) in the machine direction (MD) and the cross machine direction (CMD) for any individual test specimen.

16. The woven silt fence fabric of claim 1, wherein the woven silt fence fabric is configured to have a calculated balanced strength less than 15% as determined by:

subtracting the lower value of the tensile strengths (per the ASTM D-4632 test method) in the machine direction (MD) and the cross machine direction (CMD) from the higher value of the tensile strengths (per the ASTM D-4632 test method) in the machine direction (MD) and the cross machine direction (CMD) to obtain a difference; and dividing the difference by the higher value of the tensile strengths (per the ASTM D-4632 test method) in the machine direction (MD) and the cross machine direction (CMD).

17. The woven silt fence fabric of claim 1, wherein the woven silt fence fabric is configured to have a calculated balanced strength of about 14% as determined by:

subtracting the lower value of the tensile strengths (per the ASTM D-4632 test method) in the machine direction (MD) and the cross machine direction (CMD) from the higher value of the tensile strengths (per the ASTM D-4632 test method) in the machine direction (MD) and the cross machine direction (CMD) to obtain a difference; and dividing the difference by the higher value of the tensile strengths (per the ASTM D-4632 test method) in the machine direction (MD) and the cross machine direction (CMD).

18. The woven silt fence fabric of claim 1, wherein the woven silt fence fabric is configured to have a calculated balanced strength of about 0% as determined by:

subtracting the lower value of the tensile strengths (per the ASTM D-4632 test method) in the machine direction (MD) and the cross machine direction (CMD) from the higher value of the tensile strengths (per the ASTM D-4632 test method) in the machine direction (MD) and the cross machine direction (CMD) to obtain a difference; and dividing the difference by the higher value of the tensile strengths (per the ASTM D-4632 test method) in the machine direction (MD) and the cross machine direction (CMD).

19. The woven silt fence fabric of claim 1, wherein the woven silt fence fabric configured to have:

a tensile strength of about 658 pounds per ASTM D-4632 in the machine direction (MD); and a tensile strength of about 660 pounds per ASTM D-4632 in the cross machine direction (CMD) per ASTM D-4632.

20. The woven silt fence fabric of claim 19, wherein the woven silt fence fabric comprises:

monofilament warp yarn having an oval cross-sectional shape and a denier of about 1600; and fibrillated tape fill yarn having a denier of about 5000.

21. The woven silt fence fabric of claim 1, wherein the woven silt fence fabric configured to have:

a tensile strength of about 380 pounds per ASTM D-4632 in the machine direction (MD); and a tensile strength of about 327 pounds per ASTM D-4632 in the cross machine direction (CMD) per ASTM D-4632.

22. The woven silt fence fabric of claim 21, wherein the woven silt fence fabric comprises:

monofilament warp yarn having an oval cross-sectional shape and a denier of about 1200; and fibrillated tape fill yarn having a denier of about 3000.

23. The woven silt fence fabric of claim 1, wherein the woven silt fence fabric comprises:

monofilament warp yarn having an oval cross-sectional shape and a denier of about 1600; and fibrillated tape fill yarn having a denier of about 5000.

24. The woven silt fence fabric of claim 1, wherein the woven silt fence fabric comprises:

monofilament warp yarn having an oval cross-sectional shape and a denier of about 1200; and fibrillated tape fill yarn having a denier of about 3000.

25. A silt fence system comprising the woven silt fence fabric of claim 1, and further comprising one or more support posts configured for attachment to the woven silt fence fabric for supporting the woven silt fence fabric, wherein the woven silt fence fabric is configured such that the silt fence system is usable without additional wire, netting, or chain link fence reinforcement for the woven silt fence fabric.

* * * * *